US006427513B2

(12) United States Patent
Gross-Weege et al.

(10) Patent No.: US 6,427,513 B2
(45) Date of Patent: Aug. 6, 2002

(54) PROCESS AND DEVICE FOR PRODUCING PIPES AS PER THE UOE PROCESS

(75) Inventors: Johannes Gross-Weege; Detlef Ramdohr, both of Krefeld (DE)

(73) Assignee: Mannesmann AG, Düsseldorf (DE)

( * ) Notice: Subject to any disclaimer, the term of this patent is extended or adjusted under 35 U.S.C. 154(b) by 0 days.

(21) Appl. No.: 09/825,271

(22) Filed: Apr. 3, 2001

Related U.S. Application Data

(62) Division of application No. 09/117,078, filed as application No. PCT/DE97/00114 on Jan. 20, 1997, now Pat. No. 6,253,596.

(30) Foreign Application Priority Data

Jan. 22, 1996 (DE) ..... 196 02 920

(51) Int. Cl.[7] ..... B21D 39/20
(52) U.S. Cl. ..... 72/370.08; 72/31.03
(58) Field of Search ..... 72/31.03, 370.06, 72/370.08, 370.14; 29/407.01, 407.05, 559

(56) References Cited

U.S. PATENT DOCUMENTS

| | | | | | |
|---|---|---|---|---|---|
| 2,234,863 | A | * | 3/1941 | Heetkamp | 72/370.06 |
| 2,780,271 | A | * | 2/1957 | Ewart et al. | 72/370.06 |
| 2,919,741 | A | * | 1/1960 | Strock et al. | 72/370.08 |
| 3,030,901 | A | * | 4/1962 | McConnell | 72/370.06 |
| 3,979,231 | A | * | 9/1976 | Gondo et al. | 148/593 |
| 3,981,172 | A | * | 9/1976 | Hess et al. | 72/370.08 |
| 4,047,419 | A | * | 9/1977 | Hookings et al. | 72/370.08 |
| 4,148,426 | A | * | 4/1979 | Midzutani et al. | 228/146 |
| 4,430,872 | A | * | 2/1984 | Mihara et al. | 72/51 |
| 5,794,840 | A | * | 8/1998 | Hohl et al. | 228/151 |
| 6,253,596 | B1 | * | 7/2001 | Gross-Weege et al. | 72/370.08 |
| 6,260,403 | B1 | * | 7/2001 | Johnston | 72/393 |

FOREIGN PATENT DOCUMENTS

| | | | | |
|---|---|---|---|---|
| JP | 354138858 | * | 10/1979 | B21D/39/08 |
| JP | 355070428 | * | 5/1980 | B21D/39/08 |
| JP | 356105835 | * | 8/1981 | B21D/41/04 |
| JP | 359197321 | * | 11/1984 | B21D/39/20 |
| JP | 359232621 | * | 12/1984 | B21D/3/12 |
| JP | 360021131 | * | 2/1985 | B21D/39/20 |
| JP | 361147930 | * | 7/1986 | B21D/39/08 |
| JP | 363084811 | * | 4/1988 | B21D/21/00 |
| JP | 401309724 | * | 12/1989 | 72/31.03 |
| JP | 402207930 | * | 8/1990 | B21D/39/20 |
| JP | 403094936 | * | 4/1991 | B21D/39/20 |
| JP | 405317993 | * | 12/1993 | B21D/39/20 |
| JP | 405317994 | * | 12/1993 | B21D/39/20 |

* cited by examiner

*Primary Examiner*—S. Thomas Hughes
*Assistant Examiner*—Essama Omgba
(74) *Attorney, Agent, or Firm*—Cohen, Pontani, Lieberman & Pavane

(57) ABSTRACT

The invention related to a process for producing pipes, especially large pipes, as per the UOE process, wherein the pipes, after internal and external seam welding, are incrementally calibrated by cold expansion up to half the pipe length. The cold expansion is also used for straightening. For this purpose, the pipe is clamped at the shortest possible distance in front of the expander head, the free pipe end is flexibley deformed, and the pipe is then cold expanded in a known manner. The prestress force thereby decreases and then, after the release of the clamping and the remaining prestress, the pipe moves incrementally by the amount of the expander step width, up to half the pipe length. The process is then repeated for the second pipe half.

4 Claims, 1 Drawing Sheet

PROCESS AND DEVICE FOR PRODUCING PIPES AS PER THE UOE PROCESS

CROSS-REFERENCE TO RELATED APPLICATION

This application is a Divisional of U.S. patent application Ser. No. 09/117,078, filed Jul. 21, 1998, now U.S. Pat. No. 6,253,596, which is a 371 of PCT/DE97/00114, filed Jan. 20, 1997.

BACKGROUND OF THE INVENTION

1. Field of the Invention

The invention relates to a process for producing pipes, especially large pipes, according to the UOE process.

2. Description of the Prior Art

A process known as the UOE process is the most frequently used method of producing large longitudinally welded pipes (Stradtmann, Stahlrohr-Handbuch [Steel Pipe Handbook] 10th Edition, Vulkan Verlag, Essen 1986, pp. 164 to 167). In this process, after preparation of a longitudinal edge (weld seam bevelling, bending), a U-shaped split pipe is formed from a flat sheet on a bending press (U press). Rounding into a pipe is then carried out on a different press with self-closing dies (O press). Because the pipes, after inner and outer welding, often do not meet requirements for diameter and roundness, they are then calibrated by cold expansion (Expansion).

In expanding pipes with small diameters and thick walls, a problem arises in that the curvature after longitudinal seam welding is insufficiently compensated for by mechanical expansion so that the non-straightness fails to fall within customer tolerances. To solve this problem, it has already been proposed to combine the expander with a straightening press (Iron and Steel Research Lab, Sumitomo Metal Industry Ltd. Vol. 1 (1988) p. 1569). Arranged at some distance (several pipe diameters) in front of and behind the expander head are two additional frames, in which are installed a clamping device, on the one hand, and a path-controlled bending insert, on the other. If the weld seam lies on the top (as is the case in known expanders, in which the uppermost segment of the expander head has a slot to accommodate the weld seam), the welded pipe is always curved before expansion in such a way that the midpoint of the curvature lies above the pipe or expander axis. With the help of the omnipresent support roll for the expander head, a three-point bend is realized. It is disadvantageous in this method that the pipe must execute several expansion steps before it can be grasped by the bending device. The straightening process therefore never encompasses the end areas of the pipes.

The object of the invention is to provide a method of producing pipes according to the UOE process, especially large pipes, that allows the curvature after longitudinal seam welding to be compensated for over the entire pipe length to such an extent that the non-straightness lies within customer tolerances, even in the case of pipes with small diameters and thick walls.

In contrast to the known prior art, the present invention uses cold expansion for straightening as well. In this present inventive method, the pipe to be calibrated is clamped as near as possible to an expander head, and the free pipe end is flexibly deformed. After this, the pipe is cold expanded in the known manner. This procedure is carried out incrementally in speed with the respective expander steps, up to half the pipe length. The pipe is then rotated, and the second pipe length is similarly processed. Instead of rotating the pipe, the second pipe half is similarly processed on a second expander unit in mirrored fashion. The flexible deformation, which takes the form of depression counter to the curvature of the pipe and rotation around the cross axis, produces additional force and additional moment in the clamping area. The superimposition of force, in interaction with the cold expansion by means of the mechanical expander, leads to the desired straightening effect in the area between the cold expansion and the clamping device.

The flexible deformation is established as a presetting, and the amounts thereof decrease incrementally. The degree of pipe curvature found after longitudinal seam welding is used to determine the presetting. To simplify this determination, it is assumed that the curvature within each finished lot is roughly the same. In other words, the first pipe of a production lot is measured and, given the same pipe size (diameter, wall thickness), the same material and the same welding parameters, its curvature is used for all pipes of the production lot.

BRIEF DESCRIPTION OF THE DRAWINGS

In the drawings, wherein like reference characters denote similar elements.

DETAILED DESCRIPTION OF THE PREFERRED EMBODIMENTS

Figure 1:
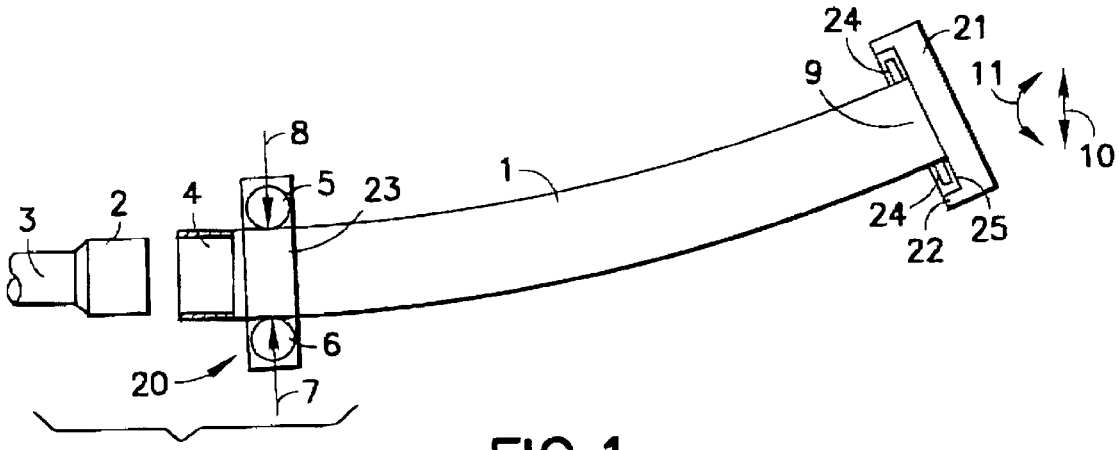
FIG. 1 shows a pipe that is curved after longitudinal seam welding.

FIG. 1 shows a pipe 1 that has become curved after longitudinal seam welding. For reasons of clarity, the curvature is highly exaggerated in the drawing. Similarly, the length of the pipe 1 relative to its diameter in the drawing is shown shorter than the actual pipe.

An expander head 2 of a mechanical expander is shown in simplified fashion. The expander head 2 is attached to an expander rod 3. The hatched area 4 at the left end of pipe 1 symbolizes the length of an expander step. In the drawing, the expander head 2 is shown offset to the left, although in the closed, i.e., non-expanded state, it is located in the interior of the hatched pipe area 4. A short distance away from the hatched pipe area 4 is a clamping device 20 In this drawing, the clamping device 20 comprises two rolls 5, 6 arranged on opposing sides of the pipe 1. The arrows 7, 8 indicate the direction of clamping force exerted by the clamping device 20. Positioned at the right free roll end 9 is a gripper car 21 (shown schematically in FIGS. 1–3), whose gripping device 22 (also shown schematically) can raise and lower the pipe 1 in the direction of straight double arrow 10 as well as rotate the pipe 1 around the cross axis in the direction indicated by double turning arrow 11.

Figure 2:
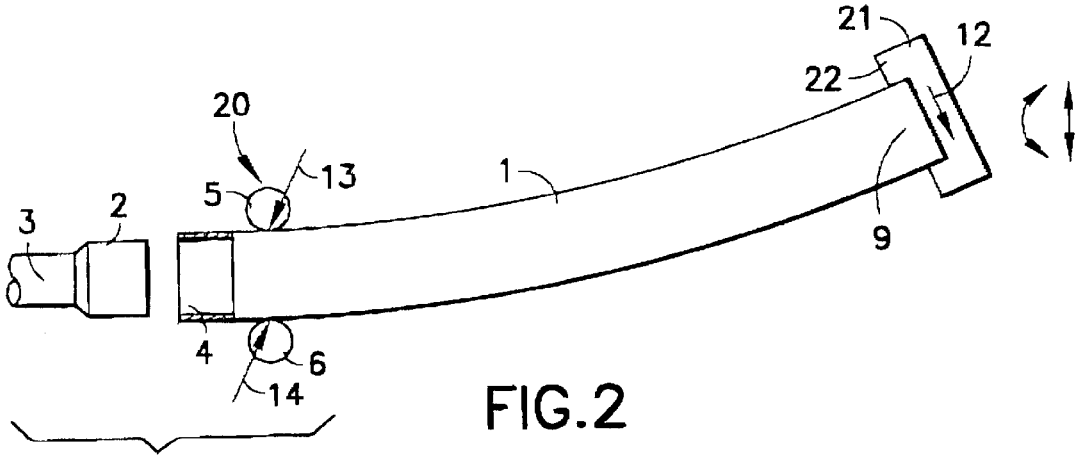
FIG. 2 shows a deformation phase of the pipe of FIG. 1.

FIG. 2 shows the deformation phase of the pipe 1. For this purpose, the pipe 1 is depressed counter to the curvature by means of the gripping device 22. The direction of this movement is symbolized here by the downward arrow 12 at the pipe end 9. At the same time, the pipe end 9 is rotated around the cross axis. The additional force and additional moment act in the clamping area, causing the action direction of the clamping force of clamping device 20 to shift, as symbolized by the slanted arrows 13, 14. At this point, the expander head 2 is still closed.

Figure 3:
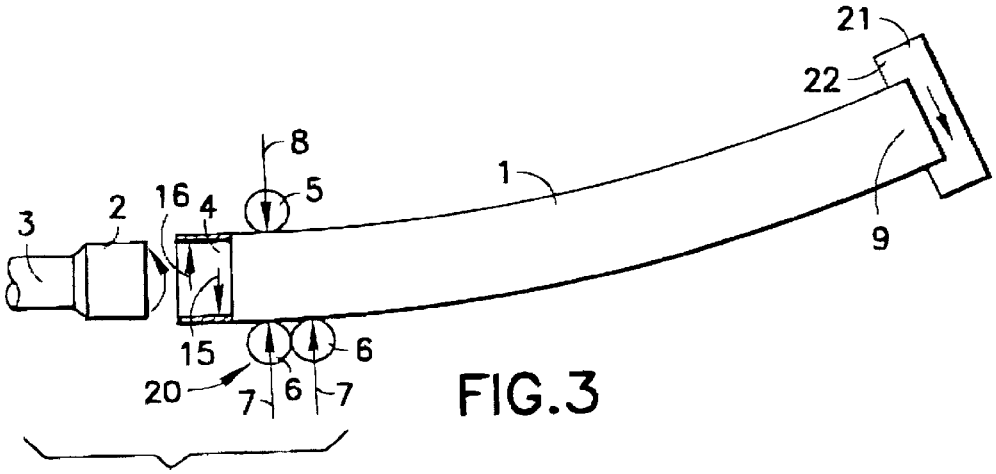
FIG. 3 shows an expansion phase of the pipe of FIG. 1.

FIG. 3 shows the expansion phase of expander head 2 and simultaneous straightening. It can be expected that the rotationally-symmetric distribution of expansion force (not shown here) will be overlaid by an additional pair of forces, with the right force arrow 15 in the hatched area 4 becoming larger than the left force arrow 16. The effect of the straightening is concentrated on the pipe 1 as a scarcely noticeable kink at the right edge of the hatched area 4.

After this, the clamping device 5, 6 and the prestress are released, and the pipe 1 is moved forward by the gripping device 22 by one expander step. The procedure described above is then repeated, the single difference being that the depression and rotation variables for the prestress become smaller with each subsequent step.

The clamping device 20 may optionally have a support 23 as shown in FIG. 1 which may, for example, be a saddle or a support shell. In addition, the clamping device 20 may have more than one roller 5, 6 on either side of the pipe 1.

The gripper device 22 may, for example, comprise spindles 24 for gripping the free end 9 of the pipe 1 and comprise piston-cylinder units 25 for causing the vertical and rotational movement imparted to the free end 9 of the pipe 1.

Patent claims:

1. An apparatus for producing a pipe having a first end and a second end comprising:

an expandable expander device insertable into the first end of the pipe being produced and being selectively switchable between a closed state and an open state;

an expander rod connected to said expandable expander device for incrementally moving said expander device into the pipe;

a clamping device for clamping the pipe at a smallest possible distance spaced from and in front of said expander device; and a gripper car having a gripping device for raising and lowering and rotating the second end of the pipe, wherein said gripper car is operatively arranged for flexibly deforming the free second end of the pipe causing a prestress of the pipe when the pipe is clamped by said clamping device, and wherein said expander device is operatively arranged for decreasing said prestress of the pipe by switching from the closed state to the expanded state for incrementally calibrating the pipe for roundness and straightening the pipe, wherein said gripping device comprises two mechanically adjustable spindles for pre-positioning and two piston cylinder units for vertical and rotational movement of the second end.

2. The apparatus of claim 1, wherein said clamping device comprises an upper roll and a lower roll mounted in a confrontingly opposed arrangement for clamping opposing sides of the pipe.

3. The apparatus of claim 2, wherein said clamping device comprises two lower rolls and said upper roll.

4. The apparatus of claim 2, wherein said clamping device further comprises one of a saddle and a support shell.

* * * * *